US006968735B2

(12) United States Patent
Ziolkowski et al.

(10) Patent No.: US 6,968,735 B2
(45) Date of Patent: Nov. 29, 2005

(54) LONG RANGE DATA TRANSMITTER FOR HORIZONTAL DIRECTIONAL DRILLING

(75) Inventors: Christopher J. Ziolkowski, Elmhurst, IL (US); Maximillian J. Kieba, Chicago, IL (US)

(73) Assignee: Gas Technology Institute, Des Plaines, IL (US)

( * ) Notice: Subject to any disclaimer, the term of this patent is extended or adjusted under 35 U.S.C. 154(b) by 36 days.

(21) Appl. No.: 10/680,540

(22) Filed: Oct. 7, 2003

(65) Prior Publication Data

US 2004/0154833 A1 Aug. 12, 2004

Related U.S. Application Data

(60) Provisional application No. 60/445,928, filed on Feb. 7, 2003.

(51) Int. Cl.[7] ..... E21B 44/00
(52) U.S. Cl. ..... 73/152.46; 324/342; 340/854.4
(58) Field of Search ..... 73/152.43; 324/342; 340/854.4

(56) References Cited

U.S. PATENT DOCUMENTS

| | | | | |
|---|---|---|---|---|
| 2,354,887 A | * | 8/1944 | Silverman et al. | 340/854.6 |
| 3,305,771 A | * | 2/1967 | Arps | 324/342 |
| 3,967,201 A | * | 6/1976 | Rorden | 340/854.5 |
| 4,181,014 A | * | 1/1980 | Zuvela et al. | 340/853.5 |
| 4,302,757 A | * | 11/1981 | Still | 340/854.4 |
| 4,525,715 A | * | 6/1985 | Smith | 340/854.5 |
| 4,578,675 A | * | 3/1986 | MacLeod | 340/853.7 |
| 4,725,837 A | * | 2/1988 | Rubin | 340/854.5 |
| 4,785,247 A | * | 11/1988 | Meador et al. | 324/338 |
| 4,786,874 A | * | 11/1988 | Grosso et al. | 340/853.4 |
| 4,812,812 A | * | 3/1989 | Flowerdew et al. | 340/853.6 |
| 4,933,640 A | * | 6/1990 | Kuckes | 324/339 |
| 5,045,795 A | * | 9/1991 | Gianzero et al. | 324/342 |
| 5,337,002 A | * | 8/1994 | Mercer | 324/326 |
| 5,463,320 A | * | 10/1995 | Bonner et al. | 324/366 |
| 5,961,252 A | | 10/1999 | Mercer et al. | |
| 6,068,394 A | * | 5/2000 | Dublin, Jr. | 702/43 |
| 6,081,116 A | * | 6/2000 | Wu et al. | 324/303 |
| 6,249,259 B1 | | 6/2001 | Goodman et al. | |
| 2004/0119607 A1 | * | 6/2004 | Davies et al. | 340/854.4 |

FOREIGN PATENT DOCUMENTS

| | | | | |
|---|---|---|---|---|
| EP | 540425 A2 | * | 5/1993 | G01V 3/20 |

* cited by examiner

*Primary Examiner*—Hezron Williams
*Assistant Examiner*—John Fitzgerald
(74) *Attorney, Agent, or Firm*—Mark E. Fejer

(57) ABSTRACT

An apparatus for monitoring conditions in subterranean borehole during drilling and pullback operations in real time. The apparatus includes a drill string having a working end. A measurement system suitable for measuring at least one operational characteristic of the apparatus and having a metallic section in direct contact with the drill string is operably connected to the working end of the drill string. At least one toroid is circumferentially disposed around a first portion of the metallic section and has toroidal electrically conductive windings. A non-conductive material is disposed around the toroid whereby contact between the toroid and a subterranean environment during operation of the apparatus is precluded.

9 Claims, 4 Drawing Sheets

LONG RANGE DATA TRANSMITTER FOR HORIZONTAL DIRECTIONAL DRILLING

CROSS-REFERENCE TO RELATED APPLICATION

This application claims the benifit of an earlier filed provisional application having Ser. No. 60/445,928 and a Filing Date of 7 Feb. 2003.

BACKGROUND OF THE INVENTION

1. Field of the Invention

This invention relates to a method and apparatus for retrieving operational data from a subterranean borehole. More particularly, this invention relates to a method and apparatus for providing a radio frequency data link between a subterranean device disposed proximate the end of a drill string whereby data related to activity at the end of the drill string can be communicated in real time to the drill rig operator. Although suitable for vertical and non-vertical drilling directions, it is particularly suitable for use in connection with horizontal drilling operations. In addition, it is suitable not only for drilling operations, but also for pullback operations. The invention includes an antenna and corresponding drill head components suitable for inducing the desired data signal into the connected drill string for communication back to the drill operator.

2. Description of Related Art

The technology of drilling gas and oil wells has advanced significantly in recent years. Part of this advancement involves new and improved techniques for drilling non-vertical (i.e. horizontal and other directional) wells. One advantage of horizontal and other directional drilling is that it enables a greater portion of the well bore to be exposed to gas or oil-producing strata, which tend to be disposed more horizontally than vertically. This enables more gas or oil to be produced from the directional well, than from a similar vertical well.

When drilling non-vertical well bores, it is common practice to use downhole sensors to measure the orientation of the well bore. The well bore orientation information gathered during drilling must be transmitted to the surface. Conventional downhole sensors used to measure well bore orientation include a three-axis accelerometer used to measure roll and inclination of the well bore, and a three-axis magnetometer (which functions as an electronic compass) to measure the well bore azimuth. Information on the well bore is conventionally transmitted to the surface of the earth using a wireline, a measurement while drilling (MWD) mud pulser, or an electric dipole.

However, conventional transmission methods and devices have certain disadvantages. Wireline systems, which use a coaxial high strength cable to connect the downhole sensors to the surface, require the use of a wireline truck. Wireline trucks are expensive, both to buy and operate. Also, the wireline must be cut and reconnected to enable the insertion of drill pipe at the surface as the well is drilled down.

MWD methods require changing the downhole fluid dynamics to propagate pressure pulses to the surface. The pressure pulses are used to encode the downhole information. MWD systems are expensive to buy and operate, and do not work well in some formations in which the circulation is lost or poor.

The electric dipole transmission method creates a downhole dipole by electrically isolating a portion of the drill pipe and impressing a voltage across it. This method is relatively simple and inexpensive. However, the technique does not work when there is a moderately conducting formation above the dipole, which shorts the dipole signal. Also, this technique cannot be used inside casings, because the casing shorts out the signal.

Magnetic dipole antenna transmission has been proposed to eliminate the above shortcomings but has yet to be perfected for practical usage.

Yet additional limitations of conventional methods and systems include a lack of range sufficient to deliver real-time data directly to the drilling machine actuating the drill string and an inability to inform the drill operator of conditions along the drill string in real-time to enable timely corrective action to be taken.

A number of systems have short-range capabilities. These typically require that a hand held unit be carried along the drill path so as to be in close proximity to the drill head. The operator carrying the hand-held unit then typically communicates verbally with the operator of the drilling rig. This can lead to delays in stopping operations when undesirable conditions occur. This approach is also unworkable where the horizontal drilling operation is under a railroad, river or busy thoroughfare.

There are also wireless approaches in which data is transmitted from the device in the buried drill string to a movable device on the surface. The data is then automatically transmitted by a second radio link in the surface device to the operator of the drilling rig. This radio-relay approach speeds up the transfer of data to the operator; however, it still requires that the movable relay device be in close proximity to the buried device traveling the drill path.

Other systems have been developed that record conditions at the drill head in an internal memory, which can be extracted after operations are complete. However, such data, although captured, cannot be used in real time to prevent undesirable conditions.

Consequently, there is a need for a method and apparatus for transmitting downhole data to the surface which is relatively simple and inexpensive, which provides a strong signal, which can be used in a wide variety of environments and which provides real-time information to the drilling rig operator.

SUMMARY OF THE INVENTION

Accordingly, it is one object of this invention to provide a method and apparatus for transmitting downhole data to an above ground location.

It is another object of this invention to provide a method and apparatus for informing a drill operator of conditions within a subterranean borehole in real time.

It is still a further object of this invention to provide a method and apparatus for transmitting data from a subterranean borehole to an above-ground location which is suitable for use in a wide variety of environments.

It is yet a further object of this invention to provide a method and apparatus for long range data transmission in horizontal directional drilling applications.

These and other objects of this invention are addressed by an apparatus comprising a drill string having a working end comprising drilling means for drilling a subterranean borehole and/or pullback means for pulling an object through a subterranean borehole. The apparatus further comprises a measurement system suitable for measuring at least one operational characteristic of the drilling means and/or the pullback means, which measurement system comprises a metallic section in direct contact with the drill string. At least one toroid having toroidal electrically conductive windings is circumferentially disposed around a first portion of the metallic section. A non-conductive material is disposed around the toroid whereby contact between the toroid and the subterranean environment and any metallic contact between sections of the drill string exterior to the toroid during operation of the apparatus are precluded.

The invention is particularly useful in any situation involving horizontal drilling apparatuses. It utilizes the metallic drill string itself as a signal conduit to deliver data to the drilling rig operator and can be used during both drilling and pullback operations. The invention utilizes a specific antenna design and corresponding drill head components to promote signal induction into the connected drill string. The transmitter is self-contained and requires no modification to the drill string or the drilling rig.

The invention utilizes the toroidal element appropriately constructed to magnetically induce a signal into the metallic structure of the transmitter. This signal is also induced into metallic appurtenances in contact with the transmitter. As a result, the signal is also induced into the attached drill string and other metallic components thereof. The frequency of the induced signal is also selected such that it is not easily attenuated by passage through soil.

The invention is utilized to capture data from the downhole end of the drill string during drilling operations. For example, it may be used to monitor downhole pressures, temperatures and the like during the drilling operation. In addition, it may also be utilized during a pullback operation to monitor the tension in a plastic pipe or conduit being installed. Sensors, a power supply and a source of data to be transmitted from the end of the drill string may be built into a drill head disposed at the working end of the drill string or they may be built into a tension measurement pod that can be attached to the working end of the drill string.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
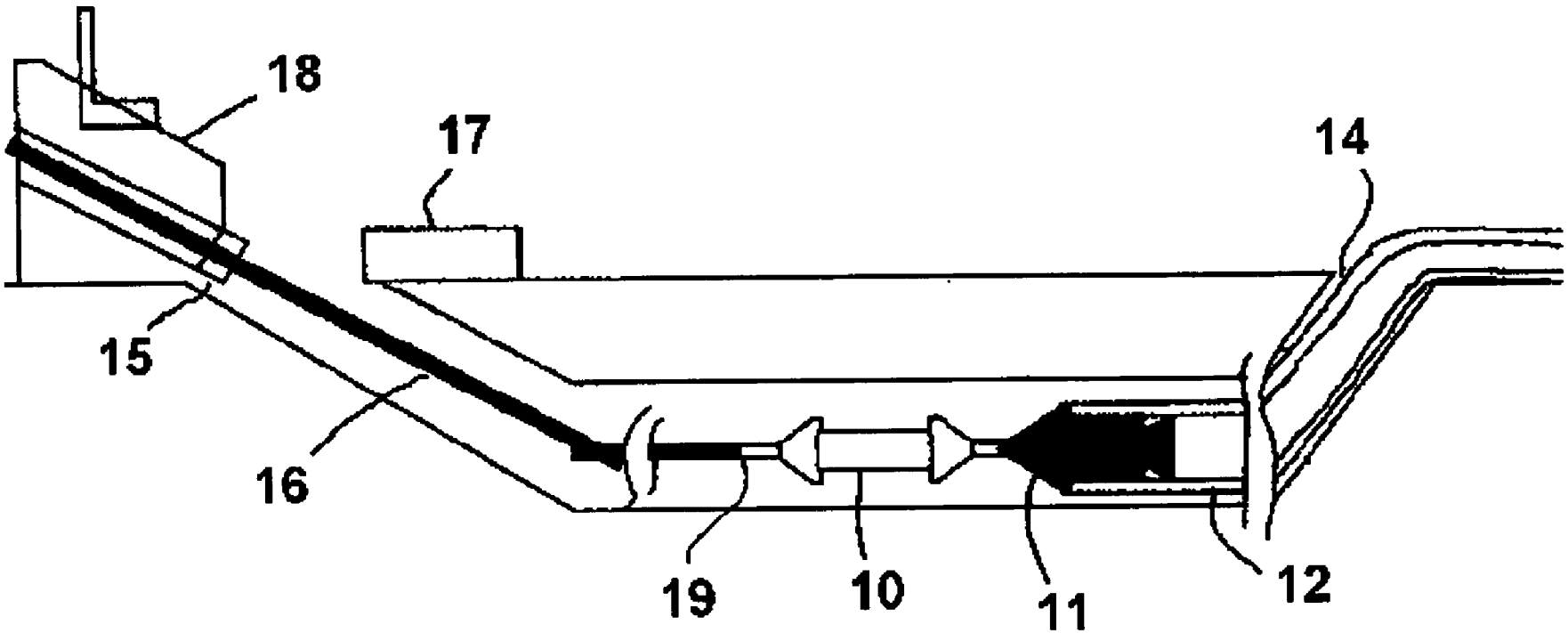
FIG. 1 is a schematic diagram showing a general overview of a drilling system for use in accordance with one embodiment of the method of this invention.
Figure 2:
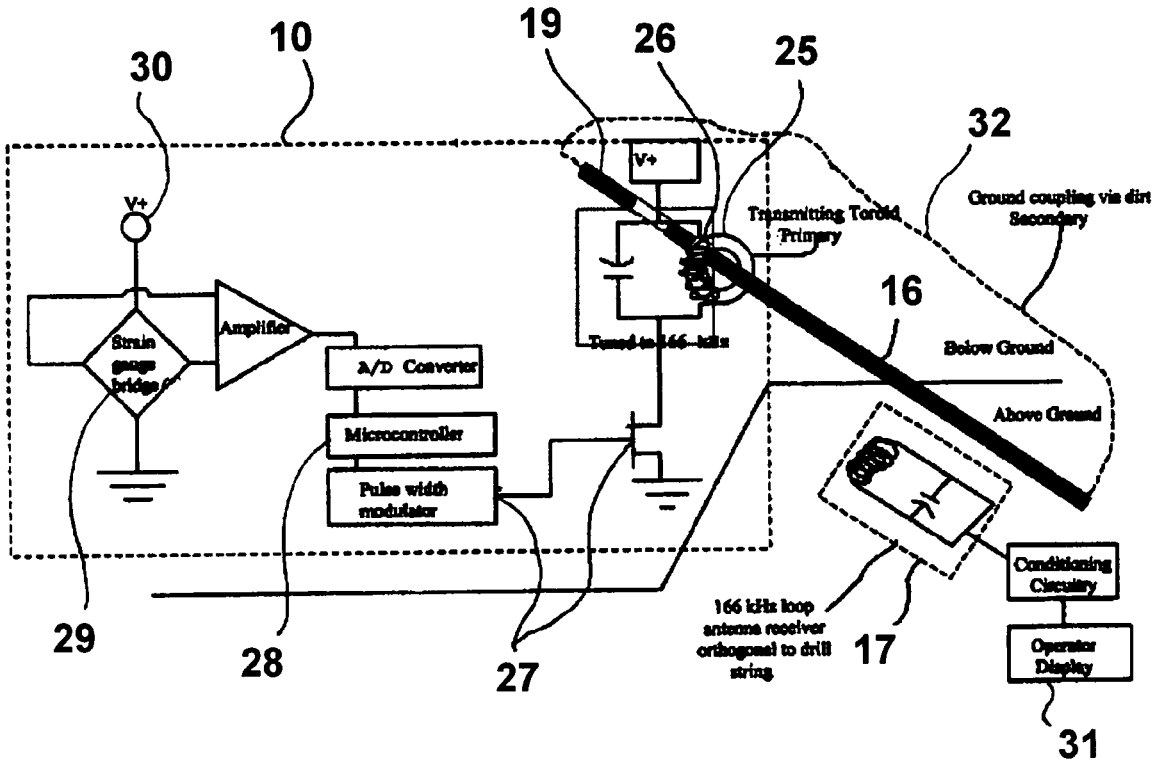
FIG. 2 is a schematic diagram showing the basic electronic components comprising one embodiment of the apparatus of this invention.

A primary object of this invention is to provide a method and apparatus for transmitting data from a subterranean borehole to a location above ground. FIG. 1 is a diagrammatic overview of a system suitable for addressing this object in accordance with one embodiment of this invention. As shown therein, the system comprises a transmitter 10 operably linked to metallic drill string 16 proximate drill string working end 19. As used throughout the specification and claims, the term "drill string" (also sometimes referred to in the art as a drill rod) refers to sections of tube or pipe and/or solid rods connected end-to-end used to drill boreholes into the ground. Such boreholes may be oriented vertically, horizontally or at an angle with respect to vertical. In the application shown in FIG. 1, metallic drill string 16 is operably connected through a first borehole opening 15 to a drill rig 18 and transmitter 10 is operably connected to a tow head 11 connected to a flexible pipe 12 for pullback through a second borehole opening 14 in the direction of first borehole opening 15. The manner in which transmitter 10 is linked to metallic drill string 16 enables drill string 16 to be used as a signal conduit to deliver data in real time to the drill rig operator. More particularly, transmitter 10 comprises a toroidal element 25 as shown in FIG. 2 appropriately constructed to induce a signal into the metallic structure of the transmitter and into metallic appurtenances in contact with the transmitter. As will be discussed in more detail herein below, in the pullback application shown in FIG. 1, transmitter 10 comprises tension measuring means for monitoring stresses during the pullback operation. Data generated by the tension measuring means is transmitted to receiver 17, which is readily accessible by the drill rig operator.

Figure 3:
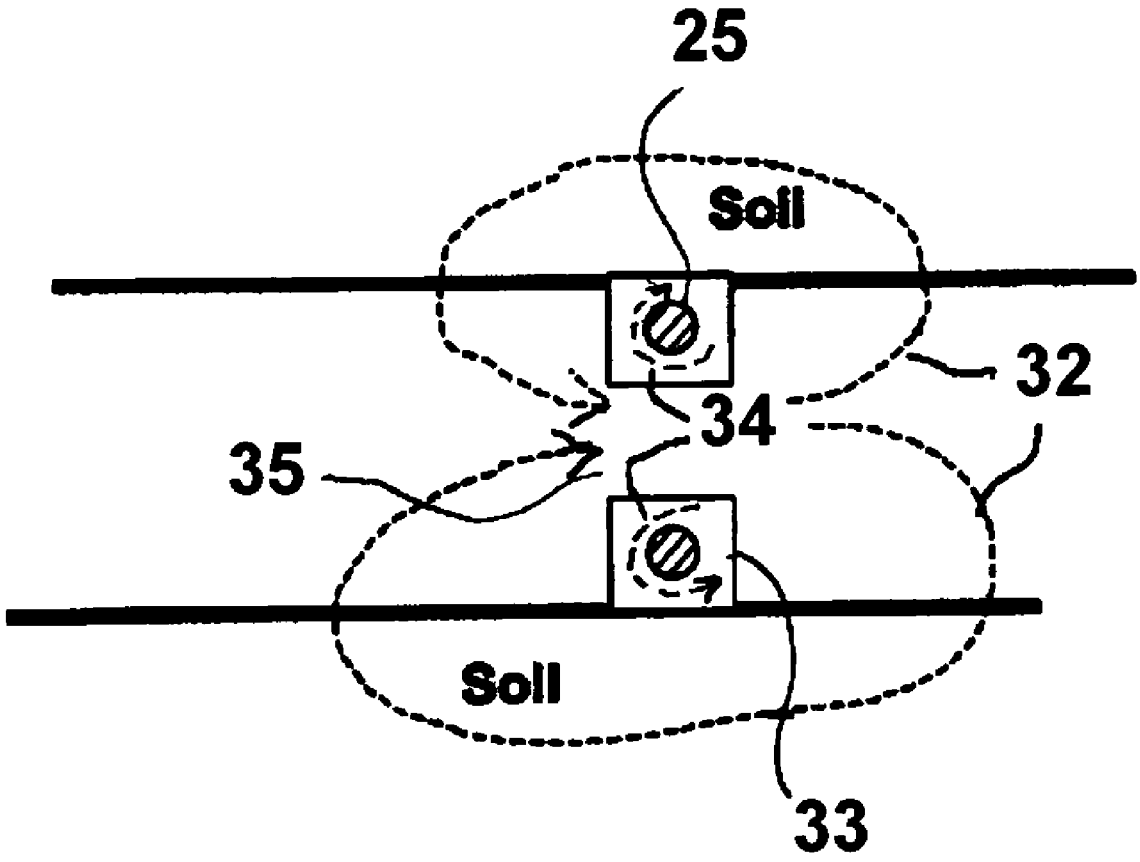
FIG. 3 is a cross-sectional view of a toroid in accordance with one embodiment of this invention.
Figure 4:
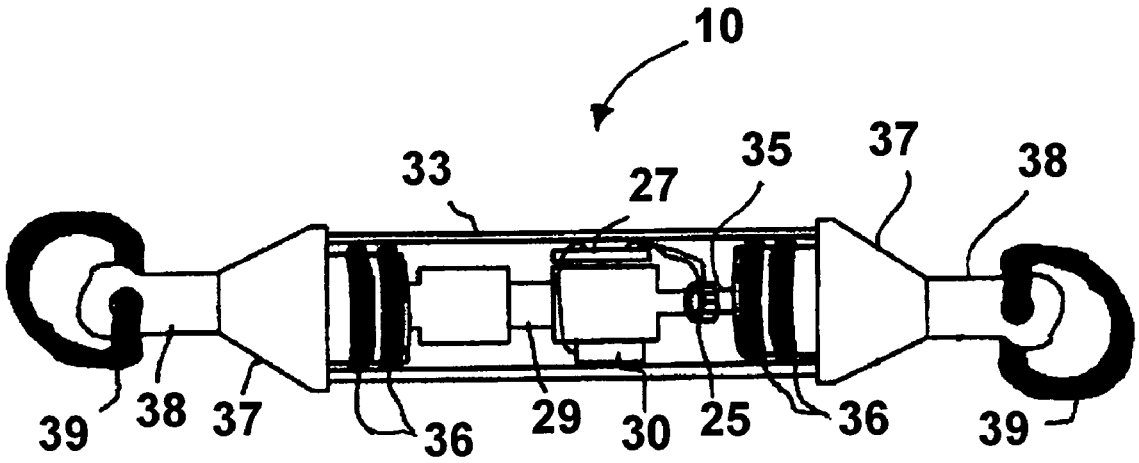
FIG. 4 is a schematic diagram of a lateral view of a tension-measuring device in accordance with one embodiment of this invention.

As previously indicated, the primary element used to induce a signal into the drill string 16 is a toroidal element 25 in the form of a toroidal core made of ferrite or other suitable magnetic material. An electrically conductive winding 26 of multiple turns of conducting wire is made upon the toroidal core 25, which is driven by transmitter circuitry to be described later. Disposed within transmitter 10 is a measurement package suitable for monitoring downhole conditions, which measurement package comprises a metallic section in direct contact with the drill string 16. Toroidal core 25 is disposed around a first portion 35 of the metallic section (FIG. 3). To prevent contact between toroidal core 25 and the subterranean environment during operation of the drilling or pullback apparatus, toroidal core 25 is enclosed within a non-conductive material 33 as shown in FIG. 3. Suitable non-conductive materials include epoxy and lexan. A second portion of the metallic section of the measurement package by way of metal cones 37 disposed fore and aft of the measurement package as shown in FIG. 4 in accordance with one embodiment of this invention is exposed to enable contact between the second portion of the metallic section and the subterranean environment during operation of the apparatus.

As shown in FIG. 3, this arrangement creates in effect a toroidal transformer. The toroidal electrically conductive winding 26 on toroidal core 25 that is driven with appropriate circuitry constitutes the primary winding 34 of the transformer. The exposed metallic section and the soil with which it is in contact forms the secondary winding/circuit 32 of the transformer. In addition, any other metallic appurtenances, such as drill string 16 and tow head 11, in direct contact with the measurement package will become part of this secondary circuit 32.

It will be apparent to those skilled in the art that there can be no metallic contact between the metal cones 37 exterior to the toroidal core 25. Thus, an additional function of the non-conductive material 33 is to preclude any metallic contact between sections of the drill string 16 exterior to the toroidal core 25. The load bearing, metallic core 35 of the measurement package must pass through the interior of the toroidal core 25. The secondary circuit 32 is, thus, completed by the soil external to the toroidal core. When the primary winding 34 is driven with an excitation current, a current is also induced into the attached drill string and surrounding soil. The resistance of the soil causes the current through secondary circuit 32 to be more evenly distributed over the entire length of the drill string 16 or other metallic appurtenances in contact with the measurement package. The distribution of the current over the length of the drill string enables the entire length thereof to act as an antenna, radiating the signal. This, in turn, enables the signal to be detected at any point along the drill string, up to and including the point at which it connects to the drill rig 18. Any undesirable exterior metallic connection between the fore and aft metal cones 37 will provide a low-resistance path for the signal currents and greatly reduce the extent of the current distribution through the soil. This, in turn, will greatly attenuate the radiated signal and reduce the range over which the data signal can be detected.

Given this basic means for coupling a signal into the drill string, a variety of signals can be used to transfer useful intelligence from the end of the drill string, traveling through the soil, and to an operator at the drilling rig. The embodiments discussed herein below utilize amplitude modulation of digital data, but other modulation schemes may be equally applied. It should also be noted that the radiated signal can also be used to locate the drill string itself in addition to providing a data transfer conduit.

FIG. 1 shows an apparatus suitable for use in measuring the tension in plastic pipe installed by a pullback method in accordance with one embodiment of this invention. In this method, two borehole openings 14, 15 are formed at the desired end points of a plastic pipe 12. A horizontal drilling rig 18 is positioned at one borehole opening 15 and a drill head, inserted into the ground through borehole opening 15, is pushed through the soil until it emerges through the second borehole opening 14. The drill head is then removed and the end of the plastic pipe to be installed is attached to the working end 19 of the drill string 16 using a fitting, such as tow head 11, designed for this purpose. Drill string 16 and the attached plastic pipe 12 are then pulled back by the drilling rig 18 until the plastic pipe extends between the two borehole openings. Using this method and apparatus enables installation of the plastic pipe without the need for trenching or other extended excavations.

In order to measure the pullback forces on the plastic pipe, a tension measurement link in the form of transmitter 10 is inserted between drill string 16 and plastic pipe 12 where it experiences the pulling force on the pipe. Transmitter 10 as shown in FIG. 2 comprises a battery 30, tension measuring load cell 29, microprocessor 28, antenna drive circuitry 27 and an antenna toroid 25 mounted as discussed below.

In accordance with one embodiment of this invention, transmitter 10, which in the embodiment shown in FIG. 4 is a tension measurement pod, comprises metallic rod or core 35 extending axially through the pod and operably connected to tension measuring load cell 29. The electronic components are enclosed within a non-conductive covering 33 in the form of a lexan tube, which is sealed at both ends by o-rings 36. Connected to each end of the transmitter/pod 10 are exposed metal cones 37. Connected to each exposed metal cone 37 is a rod end 38 and a shackle 39, whereby the pod is connected to the drill string 16 and the tow head 11. The exposed metal cones 37, rod ends 38 and shackles 39 provide contact points with the surrounding soil and exterior metallic appurtenances including the drill string 16 and the tow head 11. In accordance with one preferred embodiment, rod ends 38 and shackles 39 are connected to metal core 35 whereby, in addition to the metal core 35 and load cell 29, rod ends 38 and shackles 39 are load bearing. Although they are in contact with the rod ends, the exposed metal cones 37 generally are not load bearing members. Internal o-rings 36 disposed between the cones 37 and the metal core 35 help with sealing, but the cones 37 are not threaded to either the metal core 35 or the rod ends 38. It will be apparent to those skilled in the art that other equally suitable designs exist for such a pod, which so long as there is no metallic contact exterior to the toroid between the metallic cones 37 are deemed to be within the scope of this invention.

The transfer of the signal from the transmitter/pod 10 to the drill string 16 requires only simple metallic contact with a mating shackle 39 at the end of the transmitter/pod 10. No modifications to the drill string or the drilling rig are required for the desired transmission to occur. In one field test, transmission through 500 feet of drill string was obtained using the disclosed tension measurement pod 10 and a small receiver located at the drilling rig. It was also observed during this test that the transmission could be detected at any point along drill string 16.

The receiver 17, shown in FIG. 1, captures the data from the pod 10 using a simple flat coil antenna about 8 inches in diameter consisting of multiple turns of wire. This antenna is laid flat on the ground to one side of the drill path. It has been demonstrated to work in close proximity to the drilling rig proximate one end of the drill string. It has also been demonstrated that the receiver can be moved to various points along the drill string and still receive the transmitted data.

In the embodiment shown in FIG. 2, the carrier frequency for the data signal was selected to be 166 kHz. One skilled in the art will appreciate that higher frequency radio waves are more greatly attenuated by passage through soil, necessitating the use of a relatively low frequency. There are also regulatory considerations as to the frequencies allotted by the FCC for underground applications. The frequency of 166 kHz was selected on the basis that it is easily produced by the microprocessor within the pod and that it falls within the allowable range set by other considerations.

In accordance with one embodiment of the method of this invention for retrieving operational data from a subterranean borehole, a data transmitter connected to a drill string proximate a working end thereof is inserted into the subterranean borehole. A measurement system operably connected to the data transmitter is inserted into the subterranean borehole. At least one operational parameter of a downhole operation in the subterranean borehole is measured by the measurement system and data corresponding to the at least one operational parameter is transmitted using the data transmitter through the drill string to a receiver without employing any intermediate relay device between the transmitter and the receiver.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. An apparatus comprising:

a drill string having a working end comprising at least one of drilling means for drilling a subterranean borehole and pullback means for pulling an object through a subterranean borehole;

a measurement system suitable for measuring at least one operational characteristic of at least one of said drilling means and said pullback means, said measurement system comprising a metallic section in direct contact with said drill string;

at least one toroid circumferentially disposed around a first portion of said metallic section and having toroidal electrically conductive windings; and a non-conductive material disposed around said toroid whereby contact between said toroid and a subterranean environment during operation of said apparatus is precluded.

2. An apparatus in accordance with claim 1, wherein a second portion of said metallic section is exposed whereby contact between said second portion and said subterranean environment during said operation of said apparatus is enabled.

3. An apparatus in accordance with claim 1, wherein said measurement system comprises a tension measurement means connected to said working end of said drill string.

4. An apparatus in accordance with claim 1, wherein said measurement system is disposed within a drill head connected to said working end of said drill string.

5. An apparatus in accordance with claim 1, wherein said measurement system comprises at least one of temperature means for measuring temperature within said subterranean borehole and pressure means for measuring pressure within said subterranean borehole.

6. An apparatus in accordance with claim 1, wherein said drill string is adapted for at least one of horizontal drilling and horizontal pullback.

7. An apparatus comprising:

at least one of a metallic pipe and a metallic rod suitable for at least one of drilling a subterranean borehole and pulling an object through a subterranean borehole;

a transmitter in direct metallic contact with said at least one of said metallic pipe and said metallic rod;

a measurement system suitable for measuring at least one operational characteristic of at least one of said drilling and said pulling disposed within said transmitter, said measurement system comprising a metallic section in direct contact with said at least one direct metallic contact; and said transmitter comprising a toroid disposed circumferentially around at least a portion of said metallic section and having toroidal electrically conductive windings, and at least one non-conductive material disposed around said toroid, whereby contact between said toroid and an environment surrounding said transmitter is precluded.

8. An apparatus in accordance with claim 7 further comprising a data receiver operably connected to one of said metallic pipe and said metallic rod, whereby said one of said metallic pipe and said metallic rod is a conduit for transmission of data between said transmitter and said data receiver.

9. An apparatus in accordance with claim 7, wherein said measurement system comprises a tension measurement device, said tension measurement device being disposed between and connected to said at least one of said metallic pipe and said metallic rod and said object.

* * * * *